United States Patent [19]

van den Bosch-Meevis et al.

[11] 4,192,046

[45] Mar. 11, 1980

[54] LOCKING APPARATUS FOR BAR-SHAPED ELEMENTS AS USED IN WEAVING

[76] Inventors: Henriette M. J. van den Bosch-Meevis, 97 Nieuwe Steeg, Leersum; Martinus H. J. Meevis, 51, de Wever, Veldhoven, both of Netherlands

[21] Appl. No.: 885,666

[22] Filed: Mar. 13, 1978

[51] Int. Cl.[2] ..... D03D 29/00

[52] U.S. Cl. ..... 28/151; 139/34

[58] Field of Search ..... 139/29, 33, 34; 28/149, 28/151, 152

[56] References Cited

U.S. PATENT DOCUMENTS

| | | | |
|---|---|---|---|
| 1,675,886 | 7/1928 | Denney | 28/151 |
| 1,681,356 | 8/1928 | Luckwell | 139/33 |
| 2,224,563 | 12/1940 | Clark | 139/34 |

FOREIGN PATENT DOCUMENTS

| | | | |
|---|---|---|---|
| 612662 | 5/1935 | Fed. Rep. of Germany | 28/151 |
| 670826 | 8/1929 | France | 28/151 |
| 2307069 | 11/1976 | France | 28/151 |

*Primary Examiner*—Henry Jaudon

*Attorney, Agent, or Firm*—Barry G. Magidoff

[57] ABSTRACT

A locking apparatus for weaving by means of small bores, consisting of a lower block and an upper block, one surface of a block is provided with centering ribs forming channels. The bars are accommodated in the channels and maintained by pressing the upper block towards the lower block.

11 Claims, 12 Drawing Figures

LOCKING APPARATUS FOR BAR-SHAPED ELEMENTS AS USED IN WEAVING

BACKGROUND OF THE INVENTION

The invention relates to a locking apparatus for bar-shaped elements, more particularly a locking apparatus for small bars as used in the weaving technique by means of small bars.

In this known technology as described in the booklet "Weven op Stokjes" (Weaving on small bars) by Rita Kok and Elly Niemans, published by Cantevleer B.V. at De Bilt, the bars have to be held in hand or be laid on a table and it is very difficult to hold the bars parallel at a certain distance from each other, particularly if the work has to be done with several bars. Moreover, such a technology cannot be applied by persons who miss the use of a hand entirely or partially.

SUMMARY OF THE INVENTION

The invention now aims to provide a locking apparatus for locking bar-shaped elements at desired distances or according to a predetermined pattern and which may be operated with very simple movements of the hand, even with one hand.

For this purpose, the invention provides a locking apparatus for bar-shaped elements, comprising at least one lower block, at least one upper block, at least one gripping element for fixing the blocks mutually with respect to each other and bar centering elements arranged on at least one surface of one of the blocks, for holding the bar shapes elements parallel to each other, wherein pushing means engage the upper block such that the upper block is subjected to an upward force.

The pushing means are preferably a resilient means, more preferably a spring element.

The bar-shaped elements are placed between the blocks which are then fixed by means of the gripping element.

The centering elements for the bar-shaped elements may in general be made up of parallel channels. These channels may be formed on a plane of a block in different manners, for instance by making ribs running parallel on the plane of the block, or by forming parallel grooves in the block surface. The channels may possess various dimensions and/or shapes, so that bar-shaped elements of different diameter may be fastened.

According to a preferred embodiment, a block is provided with centering elements on the lower and on the upper plane. In this manner, it is possible to use the same block for locking bar-shaped elements of different diameters by simply reversing the block.

According to another embodiment, a block is provided with cantering elements on its four surfaces, so that the four surfaces may be used for the fixation of bar-shaped elements with different diameters and/or according to different patterns. For instance, dissimilar centering elements are obtained in that the centre distances on the one surface differ from those on the other surface.

Furthermore, it is possible to provide a block surface with dissimilar channels according to a defined pattern.

The gripping element may comprise at least one screw provided with a grip and a screw thread made in the lower block. According to another embodiment, the gripping element comprises a pivotal connection between two blocks and a screw. In still another embodiment, the gripping element comprises two screws and screw theads arranged in the lower block. The latter embodiment presents the advantage that the upper block may be pressed very uniformly, whilst also the replacing of blocks with different centering elements is facilitated.

Furthermore, in order to facilitate the operation of the apparatus a spring element may be arranged between the upper and the lower block as a result of which, in case of releasing the pressing force on the bar-shaped elements, the upper block is automatically pressed upwardly.

According to a preferred embodiment of the apparatus according to the invention, one of the planes of one of the blocks contacting the bar-shaped element is coated with flexible material such as polyethylene. In this manner, it is prevented that in case of slight differences, if any, in the diameters of the bar-shaped elements some of them are gripped and others not. By the layer of flexible material, for instance rubber or a plastic, all elements are uniformly held. This is of special importance at the start of the work when there is still no fabric between the blocks.

The lower block may be fastened to a foundation, for instance a table, in different manners. For this purpose, the apparatus is provided with a whether of not removable fastening element, for instance a clamp.

For the manufacture of the apparatus, use may be made of various materials, such as wood, plastics either or not coloured, aluminum and the like.

SURVEY OF THE DRAWINGS

Figure 3A:
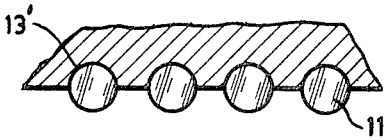
Figure 3B:
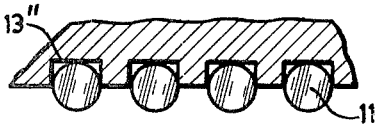
Figure 4A:
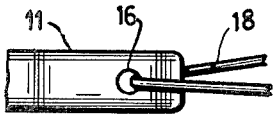
Figure 4B:
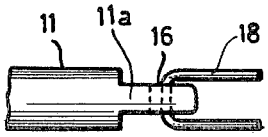
Figure 4C:
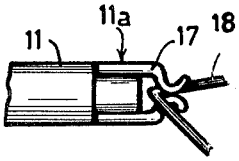
Figure 5:
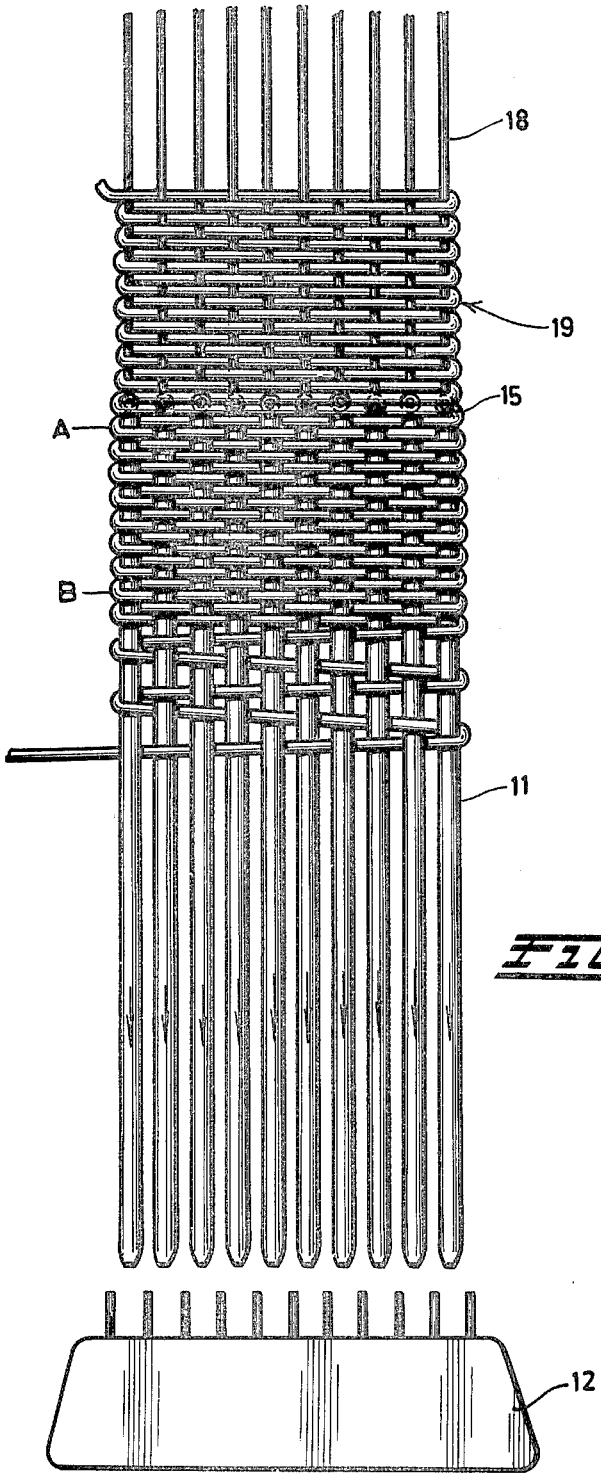
Figure 6:
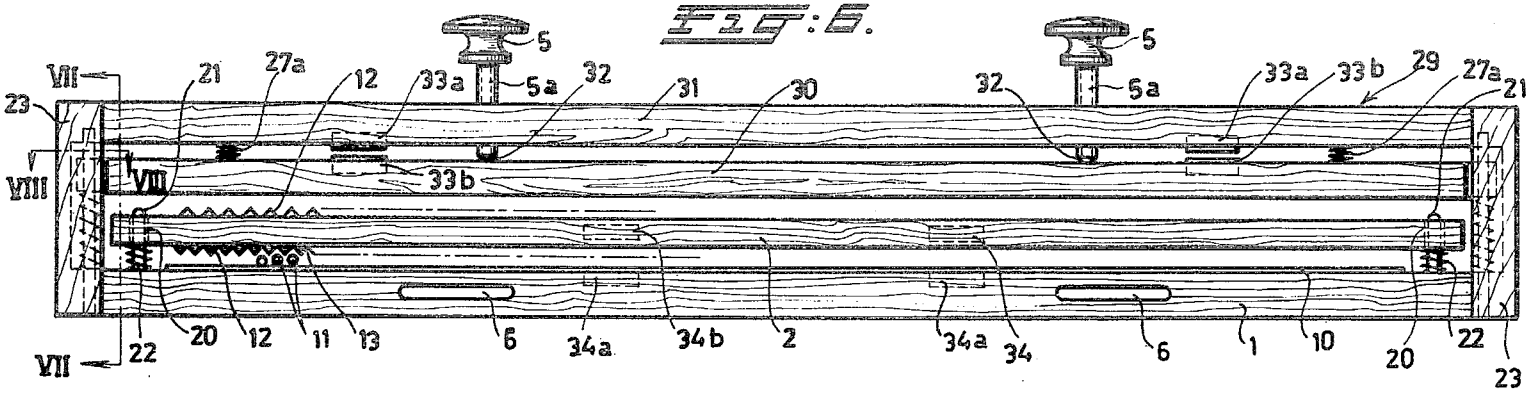
Figure 8:
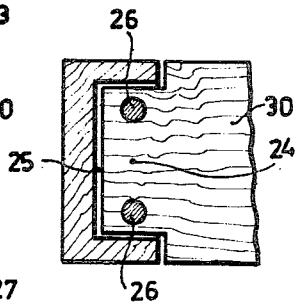
Figure 7:
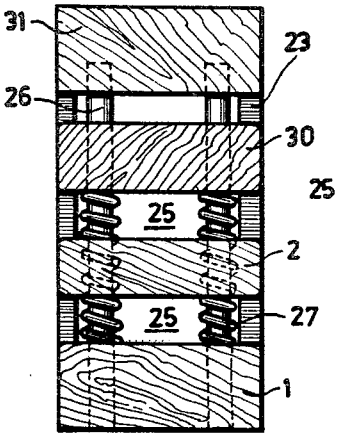

FIG. 3*a* and 3*b* are variant embodiments of centering elements;

FIG. 4*a*–4*c* show variant embodiments of the ends of sticks for fastening the warp threads;

FIG. 5 shows a top view of a piece of work with a comb to be applied in weaving;

FIG. 6 shows an elevation of another embodiment of the apparatus of the invention;

FIG. 7 a cross-section according to line VII—VII;

FIG. 8 a cross-section according to line VIII—VIII, and

Figure 1:
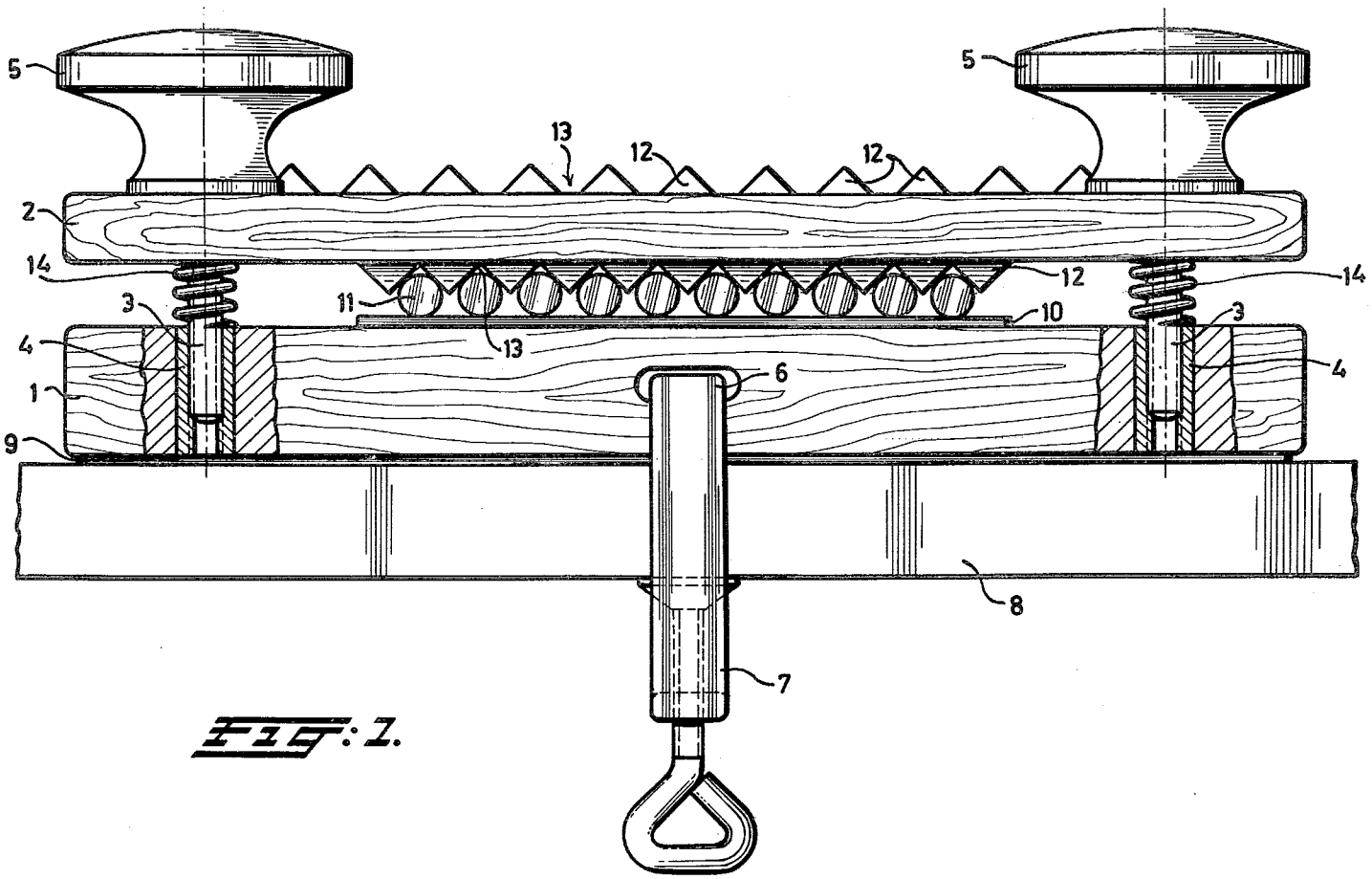
FIG. 1 is an elevation of an embodiment of an apparatus according to the invention, partially in cross-section.
Figure 9:
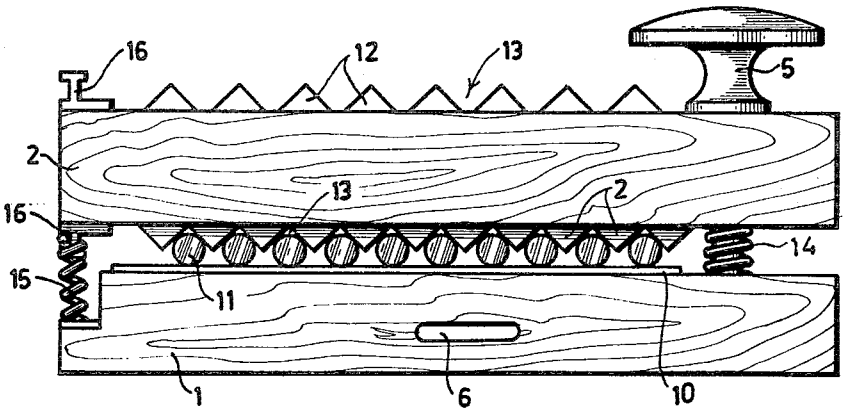

FIG. 9 another embodiment of the apparatus according to FIG. 1.

DESCRIPTION OF A PREFERRED EMBODIMENT

The embodiment of a locking apparatus according to the invention illustrated in FIG. 1 comprises a lower block 1 and an upper block 2, which, by means of screws 3, may be fixed with respect to each other.

In the lower block 1, which is made of wood for instance, there are arranged two metal bushes 4 provided with screw thread in which the screws 3 provided with knobs 5 fit. The lower block 1 is provided with a groove 6 into which a clamp 7 of a known type my be pushed, so that the lower block 1 may be fastened to a support 8, such as a table 8 which is shown schematically. In the embodiment shown in the drawing, the lower block 1 is coated on the lower side with a protecting layer of material 9, for instance felt, as a result of which damage of the table 8 and/or slipping of the lower block 1 is prevented. On the upper plane of the lower block 1 there is arranged a layer of flexible plastics material 10, preferably a polyethylene layer, as a result of which the wooden bars 11, despite slight differences in diameter, if any, may be well locked.

On its upper and lower side the upper block 2 is provided with ribs 12 having a triangular cross-section and forming channels 13, the ribs on the one side being located at shorter distances from each other than thos on the other side, so that the block may be used two-sidedly for bars with diferent diameters. Spring elements 14 around the screw 3 ensure that the upper block 2 is automatically pressed upwards when the screws 3 are loosened so that the piece of fabric is released.

Figure 2:
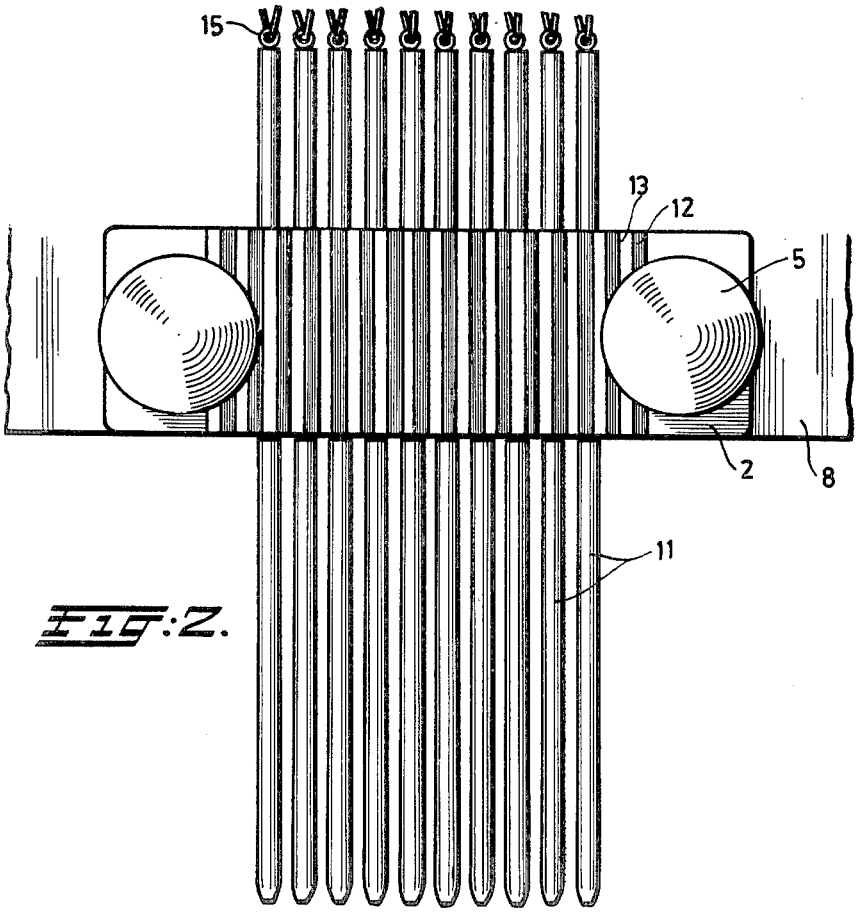
FIG. 2 is a top view of the apparatus of FIG. 1, with sticks clamped therein.

In FIG. 2, which illustrates a top view of the apparatus of FIG. 1, the same numerals have been used for the various elements. This figure also illustrates a possible fixation for the warp threads to the bars 11 in the shape of hooks 15.

FIG. 3*a* and 3*b* show some variants of embodiments of the channels for the centering of the bars, the channels 13' in FIG. 3*a* possessing a half circular cross section and the channels 13" in FIG. 3*b* possessing a rectangular cross-section and being formed in the block by cutting, for instance.

FIG. 4*a*–4*c* show a number of possibilities of fastening the warp threads 18 to the bars 11. FIG. 4*a* shows the customary fixation by means of a round hole 16. In the bar 11 shown in FIG. 4*b* the end 11*a* has been made thinner on the level of the hole 16 which facilitates the passage of the warp threads 18. In the bar shown in FIG. 4*c*, the end 11*b* is provided with a grip construction 17 which facilitates the passage of the warp threads. This grip construction comprises two tongues which engage each other clampingly.

FIG. 5 shows a top view of a piece of fabric in which the warp threads 18 fastened to the bars 11 have already been drawn partially into the texture 19. At this stage, the locking apparatus according to the invention, which is not illustrated in FIG. 5, is located between the points A and B of the piece of fabric. When the weft thread has been drawn some times between the bars, it is pressed on by the comb 12. When the work has progressed sufficiently, the screws of the apparatus shown in FIG. 1 are loosened and thus the upper block 2 is automatically pressed upward by the spring elements 14. The fabric is then pushed back so far that the locking apparatus is located right behind the last pair of weft threads. The screws are then tightened somewhat, after which the bars are drawn in the direction indicated by the arrows in FIG. 5 and the weaving may be continued.

From the foregoing it will be evident that the locking apparatus according to the invention is not only very efficient, but also that the operation thereof is most simple.

FIG. 9 shows another embodiment which differs from FIG. 1 in that only one crew 3 with knobs 5 is present. At the other end the lower block 1 and the upper block 2 are connected with each other through a spring 15. One end of the spring 15 is hingedly connected with hinge 16 being fixed to upper block 2.

FIGS. 6 to 8 show an embodiment of the device according to the invention when the device has a substantial length. In that case the upper block 2 may be guided in order to avoid irregularities in positions, due to uneven displacements of this block.

However, providing the upper block 2 with guiding projections may not be preferred in the case that the operator wants to use upper blocks with different channels and said upper block should be reversed frequently.

In using blocks 2 of a great length such as 1 meter, the use of two screws 5 as shown in FIG. 1 may also not provide suffidient force for clamping the upper block 2 onto the bars 11 supported by the upper side of lower block 1. The bushes 4 as shown in FIG. 1 will then also be subjected to rather high forces due to the action of the screw thread of screw 5.

In such case the upper block 2 is provided with bores 20 and pins 21 penetrate through these bores 20, springs 22 around pins 21 support the lower block 1. Said block 1 is now also provided with ribs 12 forming channels 12 on the upper block 2.

In order to press the upper block 2 uniformly against the bars being positioned on the upper surface of lower block 1, an additional block 30 is provided with guiding projections 24 being guided in slits 25 of the end parts 23 of a frame 29 comprising a frame upper part 31, and the lower block 1 being interconnected with end parts 23.

The additional block 30 is also provided with additional springs 27 for drawing or pushing the additional block 30 towards the frame upper part 31. These springs 27 are positioned around guide pins 26 being present in the aperture of slit 25. The additional block 30 is freely movable with respect to the guide pin 26 which penetrate through apertures in the guide projections 24.

The shafts 5*a* of the pressing means 5 may be guided through bushes with screw thread in the upper frame part 31. By screwing the shafts 5*a* downwardly the free ends 32 of the shafts 5*a* will engage the upper part of additional block 30 and further lowering of the free ends 32 will press the additional block 30 downwardly tigether with upper block 2, so that the bars 11 will be fixed. The upper part of lower block 1 is also provided with the layer 10 of flexible material such as plastics or preferably rubber material. During the downward movement of additional block 30 the additional springs 27 will be compressed and during moving the shafts 5*a* in an upward direction these additional springs 27 will push the additional block 30 upwardly thus releasing the pressure from upper block 2 so that springs 22 will push upper block 2 into an upward direction.

As already explained hereinbefore, the block 2 must be moved upwardly to a small extent in order to draw the bars 11 partially out of a weaven vabric for continuing the weaving operation. After having then refixed the bars by lowering upper block 2, by means of additional block 30, weaving is continued.

Due to the rigid frame 29 the additional block 30 may be subjected to rather high pressures by means of the shafts 5*a* and moreover the upper block 2 is subjected to an even pressure over its length.

Instead of the additional springs 27 in the slit 25 it is also possible to use springs 27*a* connecting the upper part of additional block 30 with the upper frame part 31. By turning the knob 5 upwardly the additional springs 27*a* will draw the additional block 30 towards the upper frame part 31. The upward movement of additional block 30 may also be accomplished by means of electromagnet parts 33*a*, 33*b* instead of springs 27.

It will be obvious that upper block 2 may be integral with additional block 30 and in that case the springs 27 will suffice so that springs 22 and pins 20 are then superfluous.

The bars 11 are preferably metal bars, more preferably bronze bars in all embodiments.

Instead of springs 22 also electromagnets 34*a*, 34*b* may be used.

It will also be obvious that springs 14, 22 and 27 may be replaced with bodies of compressible material.

In a very preferred embodiment the apparatus of the inventions are presented to the consumer as an assembly comprising at least an upper block a lower block 1 and knobs 5 with shafts 5*a*.

The upper block 2 as shown in FIG. 1 may also be polygonal in cross section and each surface may be provided with ribs 12 forming channels of different diameters.

What is claimed is:

1. A locking apparatus for bar-shaped elements as used in weaving, comprising at least one lower block, at least one upper block, at least one releasable gripping element for fixing the blocks at a desired distance mutually with respect to each other, and bar-centering elements arranged on at least one surface of one of the blocks for holding the bar-shaped elements parallel to each other, spring means engaged between the upper block and the lower block, the spring means having sufficient compressive force when the gripping elements fix the blocks at the desired distance, as to be capable of moving the upper block upwardly and away from the lower block when the gripping means are released.

2. The locking apparatus of claim 1, wherein the bar centering elements form parallel channels chosen from the group of channels having different dimensions and different shapes.

3. The locking apparatus of claim 1, wherein the gripping element comprises at least one shaft with screwthread, provided with a grip and a screw thread arranged in the lower block, engaging the shaft of the gripping element.

4. The locking apparatus of claim 1, wherein a pivotal connection is present between two blocks and at least one shaft with screw thread for fixing the blocks.

5. The locking apparatus of claim 1, wherein the gripping element comprises two shafts with screwthread and screwthreads arranged in the block engaging said shafts.

6. The locking apparatus of claim 1, wherein at least one bar-holding surface of one of the blocks contacting the bar-shaped elements is covered with flexible material.

7. The locking apparatus of claim 1, wherein the apparatus is provided with means for connecting a fastening element.

8. The locking apparatus of claim 1, wherein at least one of the blocks is provided with guiding means.

9. The locking apparatus of claim 1, wherein the spring means is a coiled compression spring.

10. A locking apparatus for bar-shaped elements for use in weaving, comprising at least one lower block, at least one upper block, at least one releasable gripping element for fixing the upper and lower blocks at a desired distance with respect to each other, bar-centering elements arranged on at least one surface of one of the blocks for holding the bar-shaped elements parallel to each other, spring means engaged between the upper block and the lower block, capable of moving the upper block away from the lower block when the gripping means are released, an additional block, engaged with the upper block, and guiding means on the additional block.

11. The locking apparatus of claim 10, comprising a frame including the lower block, and wherein the guiding means comprises guide projections at each end of the additional block and slits in the end planes of the frame, the guide projections being guided in the slits.

* * * * *